United States Patent [19]

Wilmes

[11] Patent Number: 4,641,443

[45] Date of Patent: Feb. 10, 1987

[54] IDENTIFICATION CARRIER FOR ELECTRIC LINES

[75] Inventor: Manfred Wilmes, Detmold, Fed. Rep. of Germany

[73] Assignee: C. A. Weidmuller GmbH & Co., Detmold, Fed. Rep. of Germany

[21] Appl. No.: 673,464

[22] Filed: Nov. 20, 1984

[30] Foreign Application Priority Data

Nov. 29, 1983 [DE] Fed. Rep. of Germany ..... 3343064

[51] Int. Cl.[4] ..... G09F 3/00

[52] U.S. Cl. ..... 40/316; 40/23 R; 40/21 R

[58] Field of Search ..... 40/21 C, 21, 23 R, 10 R, 40/10 C, 316

[56] References Cited

U.S. PATENT DOCUMENTS

| | | | |
|---|---|---|---|
| 1,298,981 | 4/1919 | Loughridge | 40/315 |
| 3,088,237 | 5/1963 | Plummer | 40/315 |
| 4,246,712 | 1/1981 | Vander Wall | 40/315 |
| 4,424,627 | 1/1984 | Tarbox | 40/315 |

FOREIGN PATENT DOCUMENTS

| | | | |
|---|---|---|---|
| 2020383 | 10/1980 | Fed. Rep. of Germany | 40/316 |

*Primary Examiner*—Gene Mancene
*Assistant Examiner*—Wenceslao J. Contreras
*Attorney, Agent, or Firm*—Sprung Horn Kramer & Woods

[57] ABSTRACT

The body of an identification carrier has two wings that surround an electric line. One part of a clip closure is mounted on a clamping strip in the path of the line. The carrier, which is secured on the line by the closure is fastened to subsequent carriers on the line by a snap connection on each face.

9 Claims, 5 Drawing Figures

IDENTIFICATION CARRIER FOR ELECTRIC LINES

BACKGROUND OF THE INVENTION

The present invention relates to an identification carrier intended for electrical lines or wires and with a two-winged sleeve-like body that surrounds the line and has a projection on one face and an accommodation for the projection on the other.

Identification carriers of this type are employed to identify lines that have already been connected. In contrast to closed identification sleeves, which are slipped on before the line is connected and cannot be released from it, the problem arises of adequately securing the identification carrier to the line once it has been mounted on it.

The body of a known identification carrier of this genus, as described in German Pat. No. 2 655 958, is in a practical way a cylindrical slotted sleeve with a projection in the form of a point on one face and an accommodation in the form of a matching notch on the other. Even when the material that a sleeve of this type is made out of has a certain inherent elasticity, however, its seating on the line will be reliable only if the line has a very specific cross-section. This is not the case for the wide range of lines being considered in the present context. Although the lateral projections and accommodations can prevent the identification carriers from rotating in relation to each other when a series of them is mounted on one line, as often occurs in practice, they do not prevent the carriers from separating from each other along the line.

To facilitate handling and storage, moreover, the identification carrier described in the aforesaid document is manufactured in one piece with a common injection-molded strip. They are slipped all together onto a supporting rod, which can also be connected to a reinforcing rod, by means of the strip and stored on the rod after the strip has been removed. This procedure is relatively complicated and necessitates additional accessories, specifically the reinforced supporting rod.

Identification devices that involve separate strips of material tensioned tightly like a strap around a cable, pipe, or similar structure and then provided with the actual identification carrier are also known from German Pat. Nos. 1 139 368 and 1 181 511. It is easy to conceive how complicated they are in design and to mount when identifying a relatively thick cable or pipe. They must also be secured reliably on the cable. This solution is unsatisfactory for the identification of already connected electric lines when it is necessary to rapidly establish the correct identification, which may also involve a large number of characters, possibly from a large number of identification carriers, and secure it to the line.

The seating of another known identification carrier German Pat. No. 1 207 203 and Öffenlegungsschrift No. 2 648 421, which is essentially a sleeve with two wings, is also not very satisfactory for a wide range of line cross-sections. It is impossible to prevent these identification carriers from rotating in relation to or separating from each other when they are mounted. Cementing the two wings of the carrier as proposed in the latter document also entails the additional drawback of making it difficult to alter the identification of the line, which can only be done by destroying the existing identification carrier, when the circuitry is rewired.

SUMMARY OF THE INVENTION

A primary object of the present invention is to provide an identification carrier of the aforesaid generic type that can be simply and reliably secured to electrical lines that have a wide range of cross-section with a satisfactory bond between several adjacent carriers. Another object of the invention is an especially simple method of manufacturing identification carriers of this type.

The former object is attained in accordance with the invention in that the body of the carrier has a clip closure and has clamping elements that can at least to some extent be displaced by the line and in that the projection and its accommodation constitute a snap-in connection.

An identification carrier of this type can easily be mounted, by slightly spreading its two wings if necessary, on a line that has already been connected and can obviously be easily closed manually around the line by activating the clip closure. The capacity of the line itself to displace the clamping elements results in an especially secure seating of the identification carrier on the line. The displacement of the clamping elements also makes it possible to vary or adjust the span of the carrier to lines with a wide range of cross-section. Thus only one type of identification carrier can be employed to identify a wide range of lines. The design of the lateral projection and its accommodation in the form of a snap-in connection makes it possible to secure a series of identification carriers mounted on one line, with the whole series involved in identifying the line, not only with respect to rotating in relation to each other but also with respect to separating from each other along the line, while retaining legibility of the identification and with the individual carriers in the series mutually reinforcing the security of their seating.

Further designs for various embodiments of an identification carrier of this type are described hereinafter. Especially emphasized is an embodiment in which one of the elements of the clip connection is mounted on one of the clamping elements. This embodiment is especially easy to handle because the clip connection can also be closed by simply pressing the carrier against the line as a result of the concomitant displacement of the appropriate clamping element by the line itself.

The clip closure in another design for another embodiment is on the free end of the wings and there are several clamping elements distributed along the length of the wings. An identification carrier of this type is closed manually, once it has been applied to the line, by closing the clip connection. The advantage of several clamping elements distributed along the length of the wings is that one carrier can be reliably secured to different lines with an especially wide range of cross-section.

The object of the invention with respect to the method of manufacture is attained by injection-molding an identification carrier with a snap-in accommodation on its face, displacing it until the end that has the accommodation demarcates another injection mold, injection-molding the next identification carrier with its snap-in projection being created by filling in the snap-in accommodation in the previously molded carrier, and repeating the procedure to create a strip of several carriers that are snapped into each other and can be pulled apart.

It is accordingly possible to employ a relatively simple injection mold to mold a theoretically infinite series of individual identification carriers that are snapped into each other and can be pulled apart without any separate mounting procedures like threading them onto supporting rods and without any accessories. The capacity for pulling apart the snapped-in carriers facilitates handling, shipping, and storing as well as processing, especially pressing, the individual pieces.

Some preferred embodiments of the invention will now be described with reference to the attached drawings, wherein:

DETAILED DESCRIPTION OF THE PREFERRED EMBODIMENTS

Figure 1:
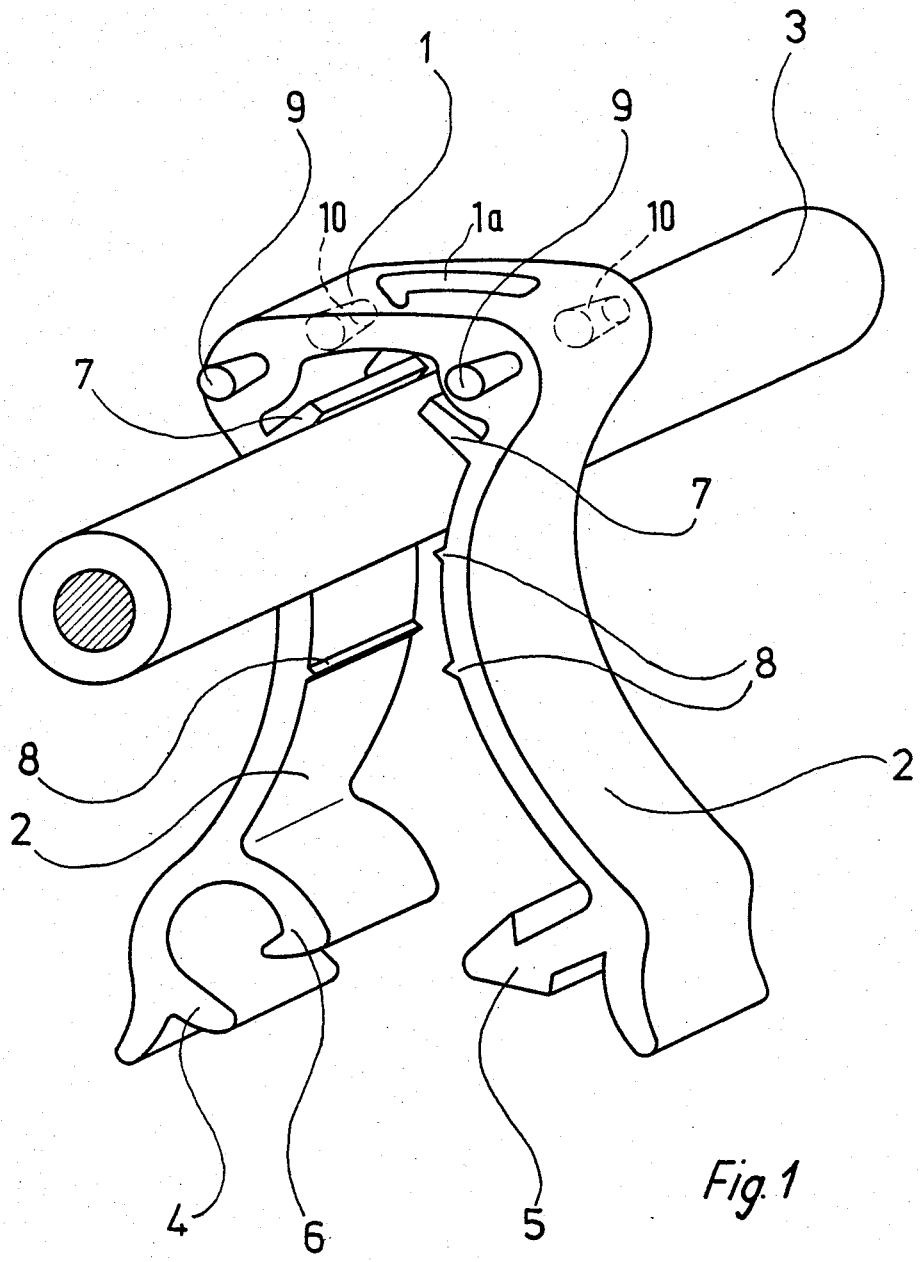
FIG. 1 illustrates an identification carrier in accordance with the invention mounted on an electric line but not yet closed.

The identification carrier for electrical lines illustrated in FIG. 1 has a sleeve-like body 1 with an identification character 1*a*, a digit or a letter for instance, applied by printing for example to its upper surface. The body 1 of the carrier in this embodiment has two relatively long wings 2 that are wrapped around an electric line 3 when the carrier is mounted on it. There is a clip closure 4 and 5 at the free ends of wings 2 that consists for example of an arrow-shaped projection 5 on one wing and a matching accommodation 4 with an abutment section 6 for the arrow on the other wing.

The illustrated embodiment has two elastically deformable clamping webs 7 inside the two wings, facing away from their free ends, and in the vicinity of the upper part of the carrier that carries the identification. Clamping webs 7 are positioned in such away that they can be displaced by line 3 itself. There are also a few small clamping ridges 8 distributed along the length of wings 2 in this embodiment.

Two snap-in pins 9 that project toward one side are also cast onto one face of the body 1 of the carrier in this embodiment. There are snap-in accommmodations 10 on the opposite side. Accommodations 10 match snap-in pins 9.

Figure 2:
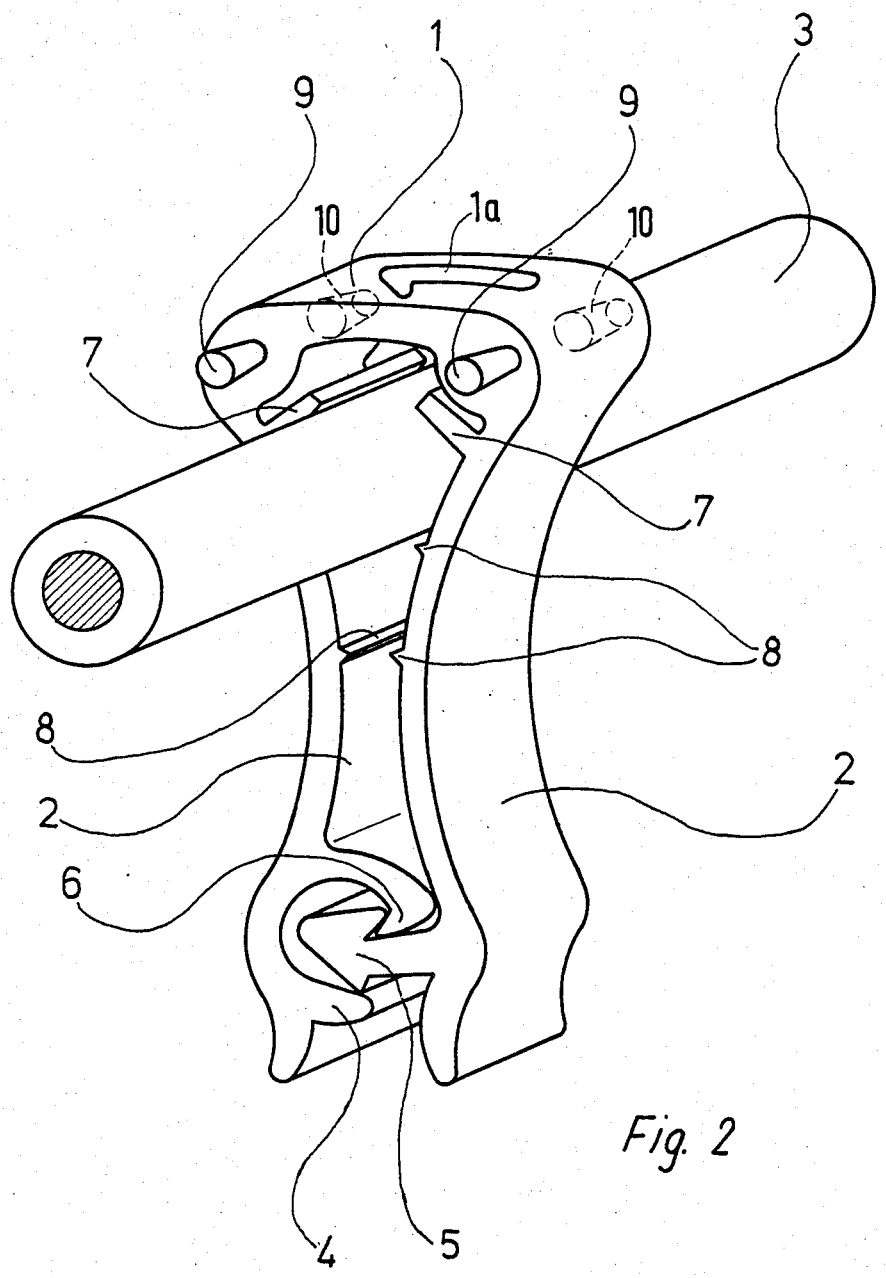
FIG. 2 illustrates the identification carrier in FIG. 1 once it has been closed.

FIGS. 1 and 2 illustrate how an identification carrier of this type is applied and secured to an electrical line. First, the body 1 of the carrier is slipped with its wings 2 still open at the bottom over line 3 until the line elastically deforms clamping webs 7. Clip closure 4 and 5 is then manually activated, forcing the two wings together with the two upper clamping ridges 8 engaging electrical line 3 at the sides in the illustrated embodiment to secure the carrier to the line.

The line is completely identified by applying the requisite number of identification carriers, each with the desired identifying digit or letter 1*a*, next to each other to electrical line 3. The snap-in pins 9 on one identification carrier will snap into the corresponding snap-in accommodations 10 in the adjacent carrier and create a practically immovable composite block of individually snapped-together identification carriers along the electrical line. The series of individual identification carriers illustrated in FIG. 5 indicates in principle how the identification carrier are positioned next to each other on an electrical line.

Even examination of FIGS. 1 and 2, however, will reveal how an identification carrier of this design can be securely mounted on electrical lines with an extraordinarily wide range of cross-section.

Figure 3:
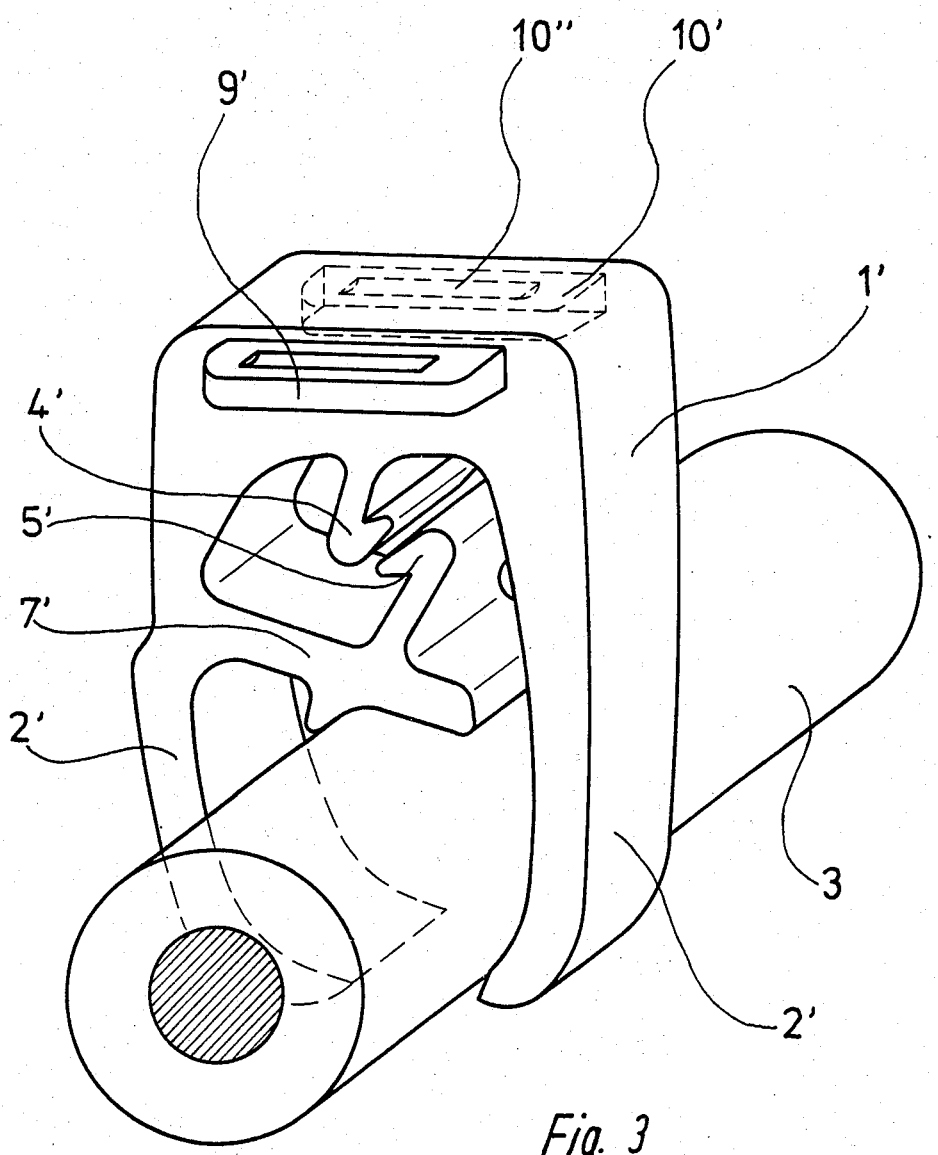
FIG. 3 illustrates another embodiment of an identification carrier in accordance with the invention while it is being closed.
Figure 4:
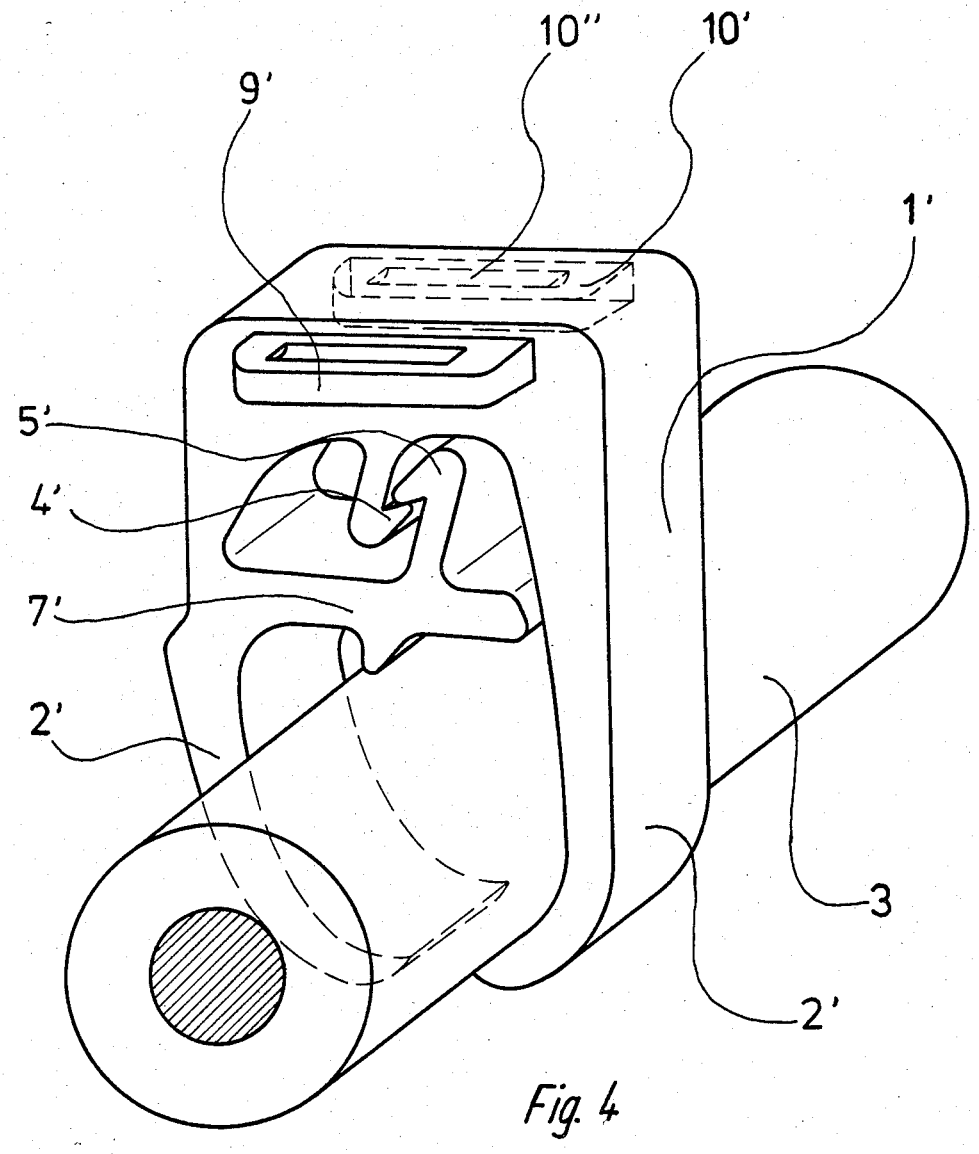
FIG. 4 illustrates the identification carrier in FIG. 3 once it has been closed.

The wings 2' on the body 1' of the carrier in the embodiment illustrated in FIGS. 3 and 4 are somewhat shorter than the wings 2 illustrated in FIGS. 1 and 2. The free ends of wings 2' are simply bent in in such a way as to surround line 3. Clip closure 4' and 5' is inside, remote from the free ends of the wings, and toward the top. The hooked web 4' of the clip closure is cast onto body 1 of the carrier'. This embodiment includes an elastic clamping strip 7' in the path of line 3. When the identification carrier is applied to the line, the line displaces clamping strip 7', which the other, hooked, component 5' of the clip closure is directly mounted on. As will be evident from FIGS. 3 and 4, it is only necessary with this embodiment to simply press the body 1' of the carrier onto line 3, whereupon clamping strip 7' and the bent ends of wings 2' will secure the carrier to the line as reliably as desired and the pressure of the line will simultaneously and automatically displace clamping strip 7' and close clip closure 4' and 5' with no separate activation of the closure being required.

The snap connection between the separate identification carriers in this embodiment when they are mounted next to each other along a line is produced by a snap-in accommodation 10' with a slightly undercut rib 10'' in it in one face of body 1' of the carrier and a matching tongue 9' projecting from the other face.

Figure 5:
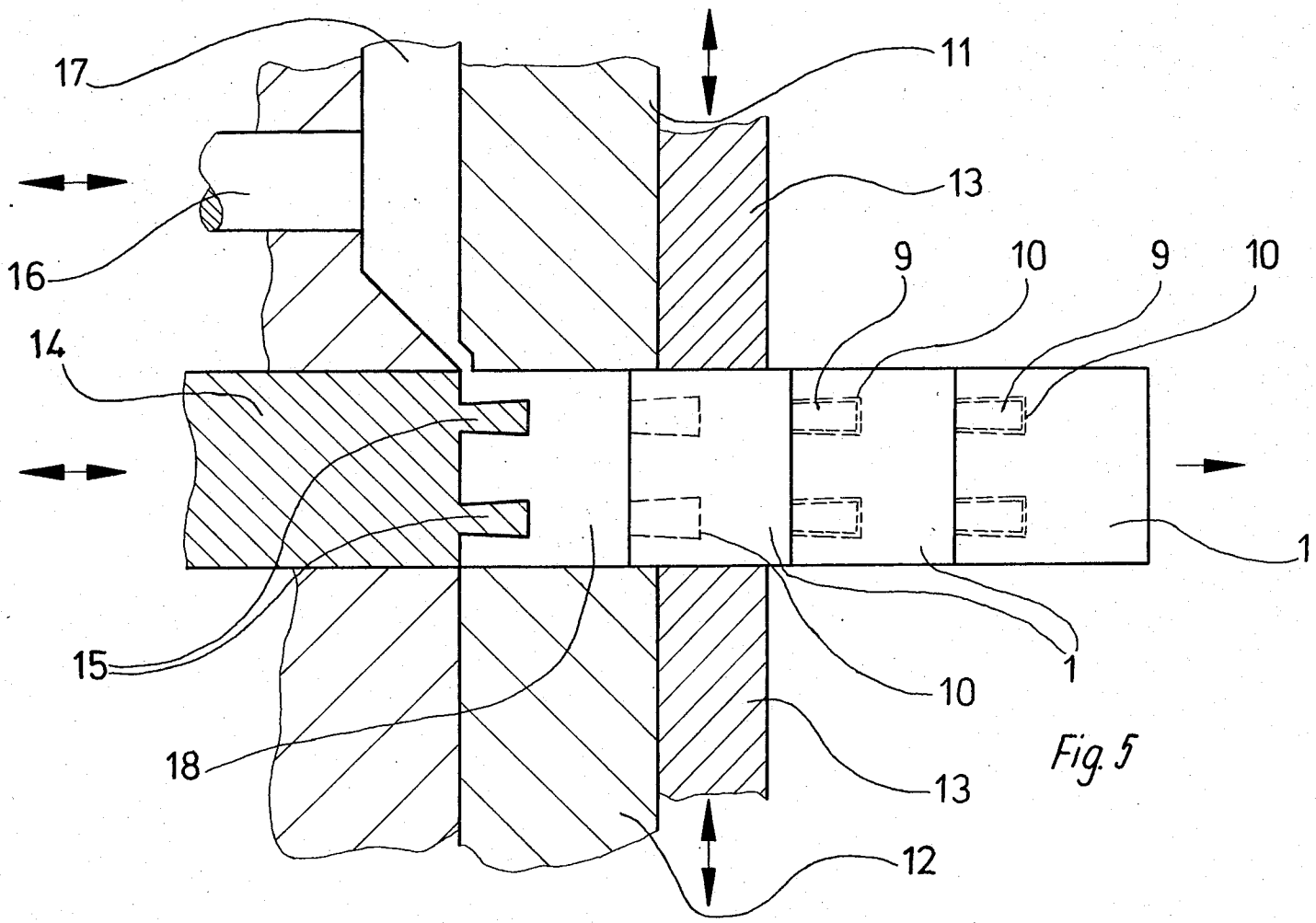
FIG. 5 is a diagram of an injection-molding tool for producing identification carriers in accordance with the invention, illustrating the method of producing them.

FIG. 5 illustrates a preferred method of manufacturing identification carriers of this type. The components of the tool include shaping plates 11 and 12, tensioning jaws 13, one ejector 14 for the identification carrier with pins 15 that match the snap-in pins 9 on the body 1 of the carrier, and another ejector 16 for the cast-on shape that forms in space 17. The pins 15 on ejector 14 project into the actual injection space 18.

At the commencement of the manufacturing process, is closed by an appropriate displacement of ejector 14 and the total closure of tensioning jaws 13. The first carrier body 1 is then injection-molded without any snap-in pins 9 and somewhat wider than the nominal width. Once the first body has been molded, tensioning jaws 13 are separated and ejector 14 forces the body out between shaping plates 11 and 12 far enough for a small part of the body, the part that has snap-in accommodations 10 left by the pins 15 on ejector 14, to remain in the mold. Tensioning jaws 13 then close again over the body, which has been forced out to that extent. Next, ejector 14 is retracted, the tool opened, and the dead head ejected by ejector 16. New molding material is then injected with the remaining portion of the first carrier body forming one wall of injection space 18. The newly injected material fills up the snap-in accommodations 10 in the first body and creates snap-in pins 9 on the new body. The procedure is repeated again and again to create a series of several carriers that are snapped into each other and can be pulled apart. The first body to be molded is subsequently removed because of its excess width and the lack of snap-in pins. It has been demonstrated that, even when a thermoplastic is employed, since the material of the individual bodies does not fuse together and the bodies will not bond or weld together, the individual bodies in a series can always be unsnapped. Still, the resulting series always holds together securely enough to facilitate subsequent processing, the imprinting of characters for example, and further handling and storage.

It will be appreciated that the instant specification and claims are set forth by way of illustration and not limitation, and that various modifications and changes may be made without departing from the spirit and scope of the present invention.

What is claimed is:

1. In an identification carrier intended for an electrical line having a two-winged sleeve-like body that surrounds the line and has a projection on one face and an accommodation for the projection on an opposite face, the improvement wherein the body of the carrier has a clip closure and has clamping elements displaceable by a line when a clip closure is closed around the line and wherein the projection and its accommodation comprise a snap-in connection, whereby the identification carrier can be used for lines having differing diameters.

2. The identification carrier as in claim 1, wherein the clip closure is disposed on the free end of the wings and there are several clamping elements distributed along the length of the wings.

3. The identification carrier as in claim 2, wherein the clamping elements comprise elastically deformable clamping webs associated with each wing and at its upper end.

4. The identification carrier as in claim 2, further comprising clamping ridges that face each other and are distributed over the length of each wing.

5. The identification carrier as in claim 1, wherein the clip closure has one element mounted on one displaceable clamping element.

6. The identification carrier as in claim 5, wherein the clip closure has a second element disposed at the section of the body that is remote from the free ends of the wings and the one element is mounted on the top of the clamping element disposed at substantially the midpoint of the wing.

7. The identification carrier as in claim 5, wherein in that the free ends of the wings on the body are rounded off to enclose a line.

8. The identification carrier as in claim 1, wherein the snap-in connection comprises undercut snap-in pins on the one face of the body and matching snap-in accommodations in the opposite face.

9. The identification carrier as in claim 1, wherein the snap-in connection comprises a laterally projecting tongue on the one face of the body and a matching accommodation with an undercut rib in the opposite face.

* * * * *